US011794956B2

(12) United States Patent
Cesare et al.

(10) Patent No.: US 11,794,956 B2
(45) Date of Patent: Oct. 24, 2023

(54) CLOSURE

(71) Applicant: Conopco, Inc., Englewood Cliffs, NJ (US)

(72) Inventors: Slavica Cesare, Trumbull, CT (US); Gregory Lalier, Brookfield, CT (US)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 17/726,393

(22) Filed: Apr. 21, 2022

(65) Prior Publication Data

US 2022/0242621 A1 Aug. 4, 2022

Related U.S. Application Data

(63) Continuation of application No. 16/065,173, filed as application No. PCT/EP2016/081755 on Dec. 19, 2016, now Pat. No. 11,312,543.

(30) Foreign Application Priority Data

Dec. 23, 2015 (EP) ..... 15202602

(51) Int. Cl.
*B65D 41/04* (2006.01)
*B65D 47/08* (2006.01)
(Continued)

(52) U.S. Cl.
CPC ..... *B65D 41/17* (2013.01); *B65D 41/0471* (2013.01); *B65D 41/34* (2013.01);
(Continued)

(58) Field of Classification Search
CPC .... B65D 41/17; B65D 41/0471; B65D 41/34; B65D 47/08
(Continued)

(56) References Cited

U.S. PATENT DOCUMENTS 2,773,521 A 12/1956 Persson
3,156,272 A 11/1964 Indrunas
(Continued)

FOREIGN PATENT DOCUMENTS

CA 2098544 12/1994
CA 2442689 10/2002
(Continued)

OTHER PUBLICATIONS

Search Report and Written Opinion in PCTEP2016081755; dated Feb. 2, 2017.
(Continued)

*Primary Examiner* — Anthony D Stashick
*Assistant Examiner* — L Kmet
(74) *Attorney, Agent, or Firm* — Gerard J. McGowan, Jr.

(57) ABSTRACT

An improved snap-on/twist off closure which is very durable. The invention is also directed to a package comprising the closure, e.g., a bottle in combination with the closure. The closure includes an upper wall defining an opening and a cylindrical snap on pipe depending from the upper wall. The pipe includes threads designed to mate with external threads on a neck of the bottle. The threads on the pipe and threads on the neck of the bottle pass over each other when the closure is snapped onto the bottle during manufacture. The pipe includes a resistance recess and a guidance recess. A bottom rim of the pipe, the resistance recess and the guidance recess are in contact with a forcing element on a shoulder of the bottle and guide the closure into positions permitting unscrewing of the closure.

10 Claims, 4 Drawing Sheets

(51) Int. Cl.
*B65D 41/17* (2006.01)
*B65D 41/34* (2006.01)
*B65D 41/16* (2006.01)

(52) U.S. Cl.
CPC ..... *B65D 47/08* (2013.01); *B65D 47/0838* (2013.01); *B65D 41/16* (2013.01)

(58) Field of Classification Search
USPC ..... 215/318
See application file for complete search history.

(56) References Cited

U.S. PATENT DOCUMENTS

| | | | | |
|---|---|---|---|---|
| 3,945,617 | A | 3/1976 | Callery | |
| 4,347,879 | A | 9/1982 | Blaser | |
| 4,456,137 | A | 6/1984 | Lyman | |
| 4,991,733 | A | 2/1991 | Marino | |
| 5,145,080 | A | 9/1992 | Imbery, Jr. | |
| 5,690,242 | A | 11/1997 | Campbell, Jr. | |
| 5,884,678 | A | 3/1999 | Chudy | |
| 5,938,082 | A | 8/1999 | Foster et al. | |
| 5,992,656 | A | 11/1999 | Dujardin et al. | |
| 6,155,462 | A | 12/2000 | Brecheisen et al. | |
| 6,237,649 | B1 | 5/2001 | Moisio et al. | |
| 6,659,145 | B1 | 12/2003 | Reif et al. | |
| 7,128,227 | B2 | 10/2006 | Skillin et al. | |
| D546,693 | S | 7/2007 | Okin et al. | |
| D542,141 | S | 8/2007 | Okin et al. | |
| 7,510,095 | B2 | 3/2009 | Comeau et al. | |
| 7,621,413 | B2 | 11/2009 | Miota et al. | |
| 8,365,933 | B2 | 5/2013 | Jackel | |
| 8,673,242 | B2 | 3/2014 | Shick | |
| 8,794,474 | B2 | 8/2014 | Mueller et al. | |
| 9,850,040 | B2 | 12/2017 | Scott et al. | |
| 10,029,903 | B1 | 7/2018 | White | |
| 10,507,957 | B2 | 12/2019 | Toh et al. | |
| 10,722,911 | B2 | 7/2020 | Surin et al. | |
| 2002/0020637 | A1 | 2/2002 | De Laforcade | |
| 2004/0245204 | A1 | 12/2004 | Suffa | |
| 2005/0205151 | A1 | 9/2005 | Behar | |
| 2007/0289670 | A1 | 12/2007 | Johns et al. | |
| 2009/0152303 | A1 | 6/2009 | Behar | |
| 2010/0288787 | A1* | 11/2010 | Jackel ..... | B65D 47/0838 220/849 |
| 2012/0318825 | A1 | 12/2012 | Beranger et al. | |
| 2013/0146174 | A1 | 6/2013 | Zinn et al. | |
| 2013/0270266 | A1 | 10/2013 | Lee | |
| 2014/0069552 | A1 | 3/2014 | Liu et al. | |
| 2014/0251938 | A1 | 9/2014 | Rose | |
| 2014/0291277 | A1 | 10/2014 | Perez | |
| 2014/0345744 | A1 | 11/2014 | Wulstein | |
| 2015/0266630 | A1 | 9/2015 | Scott et al. | |
| 2018/0237286 | A1 | 8/2018 | Seiba et al. | |
| 2020/0189809 | A1 | 6/2020 | Moskovich | |

FOREIGN PATENT DOCUMENTS

| | | |
|---|---|---|
| CN | 2734649 | 10/2005 |
| CN | 1697757 | 11/2005 |
| CN | 201400373 | 2/2010 |
| CN | 108473237 | 8/2018 |
| DE | 8702986 | 5/1987 |
| DE | 20308059 | 9/2003 |
| EA | 201891037 | 1/2019 |
| EP | 0179706 | 2/1988 |
| EP | 2921232 | 9/2015 |
| GB | 739485 | 11/1995 |
| GB | 2342347 | 4/2000 |
| JP | 5681049 | 7/1981 |
| JP | 2004136976 | 5/2004 |
| JP | 2011136745 | 7/2011 |
| KR | 20110067284 | 6/2011 |
| WO | WO9321103 | 10/1993 |
| WO | WO02081316 | 10/2002 |
| WO | WO2012092989 | 7/2012 |
| WO | WO2017108697 | 6/2017 |
| WO | WO2018114301 | 6/2018 |
| WO | WO2018220013 | 12/2018 |

OTHER PUBLICATIONS

Search Report and Written Opinion in EP15202602; dated Jun. 2, 2016.
IPRP2 in PCTEP2016081755; dated Nov. 9, 2017.
Search Report and Written Opinion in PCTEP2018064188.
Search report and Written Opinion in EP20203694; dated May 11, 2021.
Search Report and Written Opinion in PCTEP2021069616; dated Nov. 3, 2021.
Search Report and Written Opinion in PCTEP2021071341; dated Nov. 15, 2021.
Co-pending U.S. Appl. No. 15/1611781, entitled "Closure", filed Jun. 1, 2017.

* cited by examiner

CLOSURE

BACKGROUND OF THE INVENTION

Numerous personal care products are sold in plastic bottles. Examples of such products are body washes and shampoos. While dispensing of a body wash or hair care product from a bottle is convenient for the consumer, plastic bottles generally are disposed of after one use and sometimes undesirably find their way into landfills. Although plastic bottles are sometimes recycled, both transportation to the recycling facility and recycling itself utilize energy. Accordingly, it would be preferable if the packaging were re-used instead of discarded after a single use.

While some present commercial bottles could theoretically be re-used by consumers, the ease of doing so generally leaves something to be desired. For instance, it may be difficult for a consumer to remove the closure sufficiently to facilitate access to the body of the bottle. This creates a considerable impediment to the goal of minimization of plastic usage and disposal. Therefore, there has been a need for a bottle having a closure which can readily be removed by the consumer. Moreover, it is important that the consumer be able easily to again secure the closure to the bottle once she has refined the container.

Easy consumer access to the interior of the bottle is certainly desirable, but the bottle cannot be designed such that the closure will separate from the bottle too readily. Otherwise, product will be released from the container at inopportune times, such as during transportation. Also, the goal of a readily separable closure must be balanced with a competing goal, namely ease of placing the closure on the bottle during manufacture and attendant minimization of production costs.

Jackel U.S. Pat. No. 8,365,933 discloses a closure system including a snap-on closure which can be pressed upon a spout wherein two interacting elements are shifted by or over one another due to their flexibility. The closure can only be removed with difficulty in the axial/vertical direction by exerting a certain force, but can be removed by a rotational motion which is significantly easier to perform than the axial removal motion. The closure includes a recess in a cylindrical snap-on pipe which engages with a forcing element on the container shoulder. The sides of the recess are designed so that the gradient at one point on one side is smaller than the gradient at the same point on the other side.

SUMMARY OF THE INVENTION

The present invention is directed to an improved snap-on/twist off closure which does not suffer from some disadvantages of prior closures. In particular, it is very durable, as can be seen in the standard industry drop test. The invention is also directed to a package comprising the closure, e.g., a bottle in combination with the closure.

The base of the closure of the invention includes an upper wall defining an opening and a cylindrical snap-on pipe depending from the upper wall and extending vertically/axially to a bottom pipe end. The cylindrical snap-on pipe includes threads on an inner wall designed to mate with external threads on a neck of the bottle. The closure base is snap fit onto the bottle neck whereby the thread of the cylindrical snap-on pipe passes over and temporarily locks beneath the thread of the container neck.

The closure cylindrical snap-on pipe includes at its bottom end at least one resistance recess and at least one guidance recess. The resistance and guidance recesses play roles in the unscrewing of the closure whereby it can be easily removed for refilling. The resistance recess includes opposing first and second walls defined by the cylindrical snap-on pipe and which have gradients wherein the gradient of one of the walls is smaller at least at one point than the gradient on the other wall at a point lying at the same axial/vertical height.

When the closure is closed, a forcing dement from the container is at least partially accommodated within the resistance recess. The resistance recess wall with the higher gradient contacts the forcing element, which resists turning of the closure in one (non-opening/screwing closed/closure securing) direction, usually the clockwise direction. When the closure is turned in the opposite, or opening/unscrewing/closure removal direction, contact between the gentler gradient of the opposite wall of the resistance recess and the forcing element forces the closure upwardly. The flexible nature of the closure material and/or the flexibility in the snap-on pipe attributable to the presence of the recesses in the pipe permit the internal threads on the cylindrical snap-on pipe to pass over the external threads of the container neck as the closure travels axially upwardly relative to the container neck.

Upon further turning of the closure in the counterclockwise or unscrewing/opening direction, the forcing dement encounters the trailing end of the resistance recess followed by the bottom rim of the snap-on pipe and then by a guidance recess. During rotation of the closure in the unscrewing/opening direction, the guidance recess first extends upwardly from the bottom end to help to lower the cylindrical snap-on pipe relative to the container neck so that the mating threads on the closure cylindrical snap-on pipe and container neck contact each other. Thereafter, with the cylindrical snap-on pipe and neck threads in engagement, as the closure is rotated further in the unscrewing/opening/closure removal direction, the guidance recess includes a gradual downward gradient toward the bottom end of the cylindrical snap-on pipe.

The downward gradient of the guidance recess, and resultant relative upward motion of the closure consistent with the gradients of the matching threads on the container neck and skirt, provides guidance and offers minimal resistance to turning of the closure in the unscrewing/opening direction. The consumer can continue turning the closure with minimal resistance whereby to eventually remove the closure. The presence of the guidance recess also facilitates the reverse process wherein the consumer rotates the closure in the closing, usually clockwise, direction after having refilled the bottle.

The closure may include a closing dement which contacts and/or covers the top wall of the closure base to seal the closure opening, but which can be removed from the opening to dispense the product. Preferably the closing dement remains associated with the closure base when removed to dispense the product, e.g., as the result of a hinge or other attachment.

The bottom rim of the snap-on pipe extending between the resistance recess and the guidance recess is preferably at least 2 mm and is up to 5 mm, especially from 2 to 4 mm, in length whereby to maximize durability of the closure, including promoting a good, comfortably tight, fit of the closure on the bottle over a prolonged period of use.

The closure of the invention permits secure placement of a closure on the bottle neck during manufacture yet easy removal of the closure from, and re-application of the closure to, the bottle by the consumer, thereby encouraging removal of the closure to refill the container. The closure is durable, e.g., is resistant to wear and tear.

It will be apparent that changes such as the directions of screwing/unscrewing and the locations of the threads may require adjustments in the locations and shape of the resistance and guidance recesses.

For a more complete understanding of the above and other features and advantages of the invention, reference should be made to the following detailed description of preferred embodiments and to the accompanying drawings.

BRIEF DESCRIPTIONS OF THE DRAWINGS

DETAILED DESCRIPTION OF THE INVENTION

Figure 2:
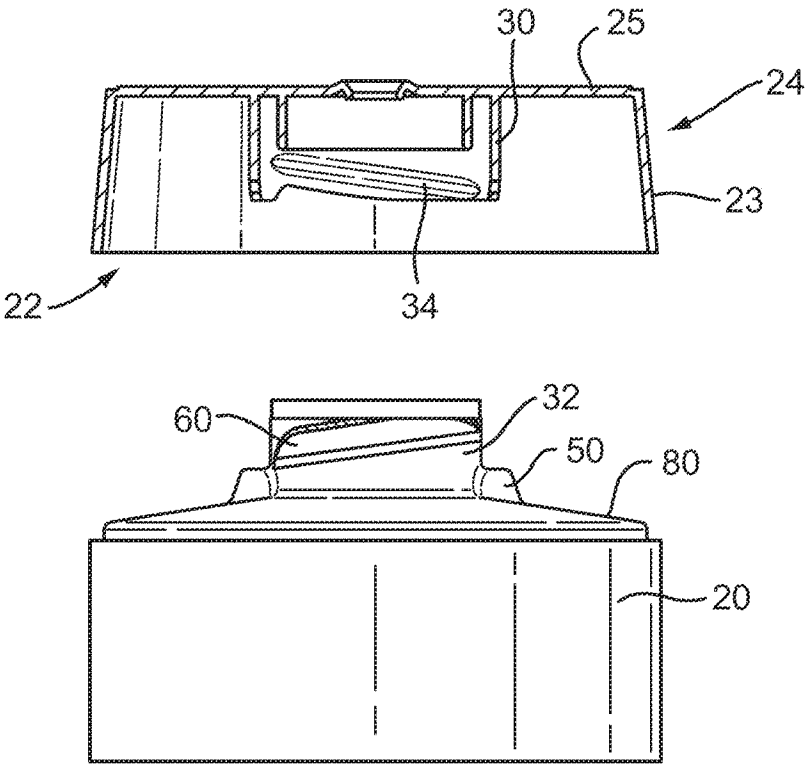
FIG. 2 is a front elevational view of a bottle of the invention with a portion of the neck cut away and showing the closure base above it in cross section with the closing cover removed.
Figure 5:
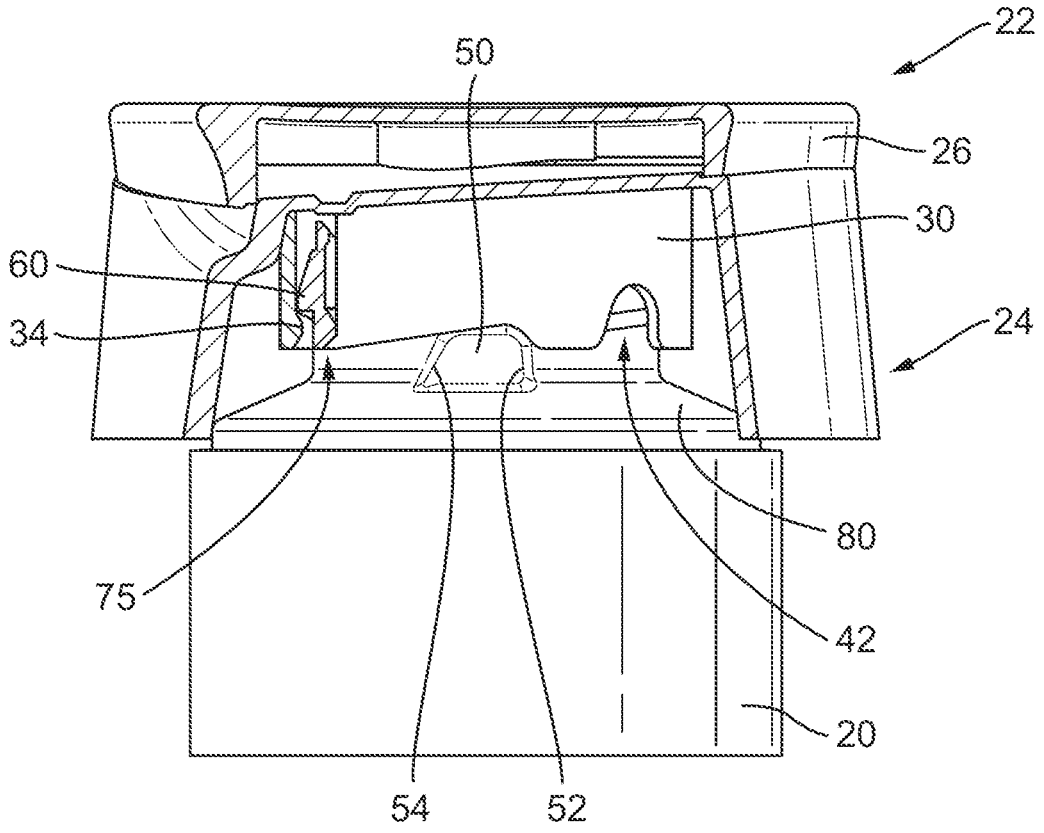
FIG. 5 is a side elevation of the package of the invention with the closure partly rotated in the unscrewing/opening/closure removal direction and with portions of the closure broken away to reveal the cylindrical snap-on pipe.
Figure 6:
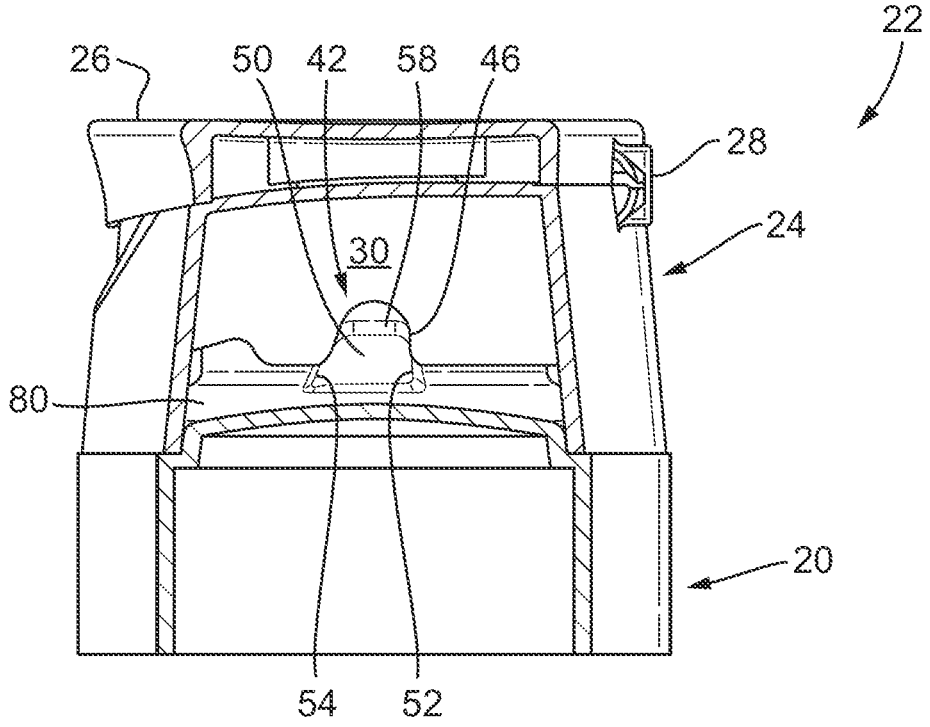
FIG. 6 is a side elevational view of an upper portion of the container with portions of the closure broken away and with the closure in the fully closed position.

Closure 22 sits on bottle 20 (FIGS. 5 and 6). Closure 22 includes closure base 24 connected to closing cover 26 by hinge 28, although other possible arrangements will be apparent to one of ordinary skill in the art. Closure base 24 includes generally cylindrical snap-on pipe 30, best seen in FIGS. 1 and 2, depending downwardly from upper wall 25. Cylindrical snap-on pipe 30 is positioned to engage neck 32 of bottle 20. The inner wall of cylindrical snap-on pipe 30 includes one or more internal threads 34, which protrude inwardly.

Closure base 24 includes a dispensing opening 36 centrally disposed within upper wall 25. Although opening 36 is illustrated and described as being centrally disposed, it may be off-center if desired. Structure may be provided above and/or below opening 36 to assist with pouring or sealing, such as ring 38. When closure base 24 is positioned on bottle 20, opening 36 is in communication with the interior of bottle 20 through the interior of snap-on pipe 30 and exterior closure base wall 23. Closing cover 26 includes plug 40 to assist in sealing the bottle.

Neck 32 of bottle 20 includes external threaded protrusion 60.

Figure 1:
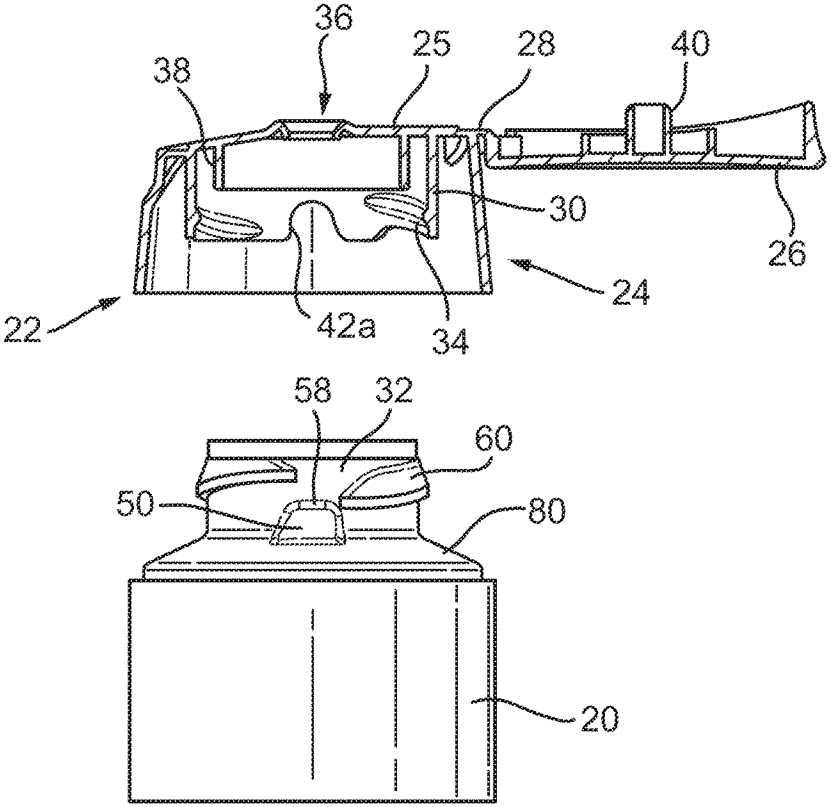
FIG. 1 is a side elevational view of the bottle and closure of the invention with the closure in cross section
Figure 3:
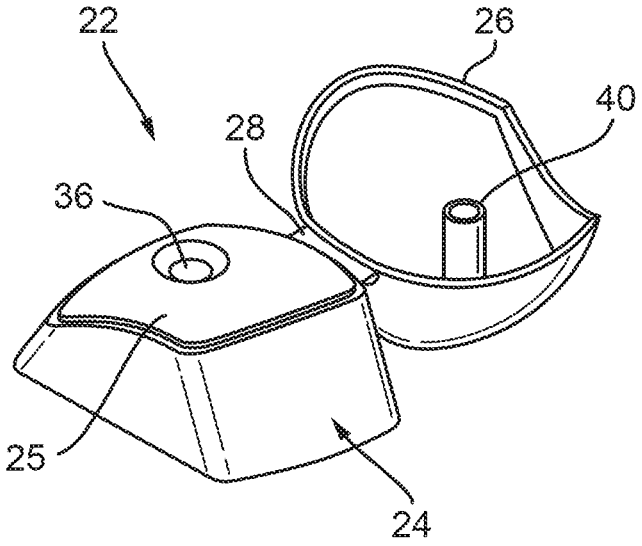
FIG. 3 is a perspective view from above of a closure according to the invention in the open position.
Figure 4:
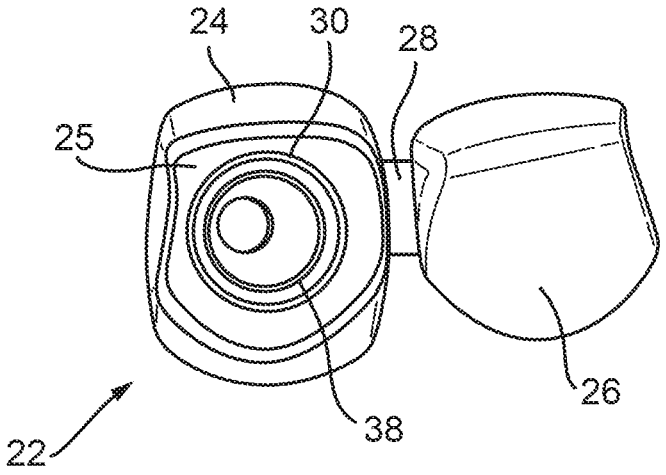
FIG. 4 is a bottom plan view of the closure of FIG. 3.
Figure 7:
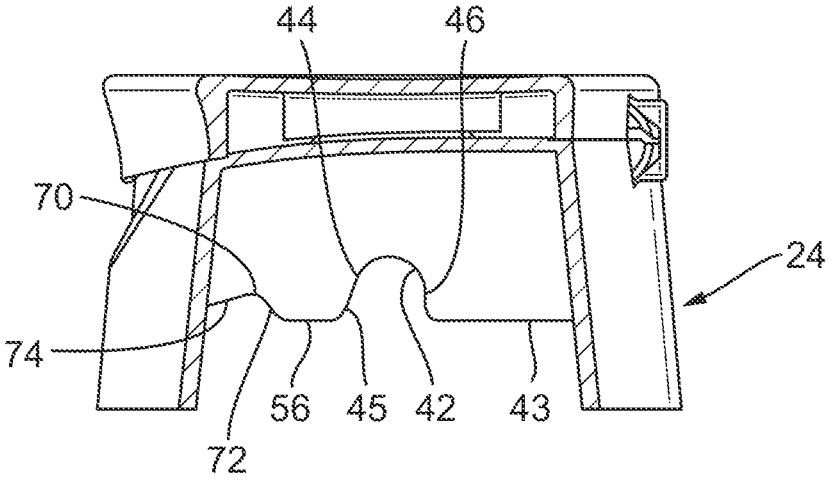
FIG. 7 is a side elevational view of the closure with portions broken away.

As best seen in FIGS. 5-7, cylindrical snap-on pipe 30 includes resistance recess 42 extending upwardly from bottom end or rim 43. Rim 43 typically extends perpendicularly to the downwardly extending axis of the pipe. A second resistance recess 42*a* may be present 180° removed from resistance recess 42, as seen in FIG. 1. Resistance recess 42 includes two walls 44, 46 formed in cylindrical snap-on pipe 30. The shape of walls 44, 46 will depend upon the direction which it is desired to have the closure rotate in order to release it from the bottle so that it can be removed.

Typically, closures are unscrewed/opened/removed by turning counterclockwise, so for the purpose of the present description counterclockwise unscrewing/opening will be assumed. However, it will be apparent that a different direction could be used if desired and the shapes of walls 44, 46 and the location of guidance recess 70 will be adjusted accordingly.

As best seen in FIG. 6, when the closure is in the closed position, resistance recess 42 receives at least part of forcing element 50, which is a protrusion permanently associated with bottle shoulder 80.

The trailing resistance recess wall during unscrewing/opening rotation, illustrated as 44 in FIG. 7, includes at its lower end 45 a gradient which is more gradual than that of the opposite (leading) recess wall 46; the gradient at the lower end of resistance recess wall 46 is more severe or steep. The forcing element 50 also includes two side walls 54, 62 of different gradients.

Starting from the initially closed position shown in FIG. 6, if the closure is rotated in the clockwise direction as the consumer turns it, a steep gradient of forcing element side wall 52 faces a steep gradient on resistance recess wall 46 and prevents rotation. On the other hand, upon rotation of the closure in the counterclockwise direction from the initially closed position, side wall 54 of the forcing element having a gentler gradient faces resistance recess wall 44 which has a gentler gradient in its lower half, e.g., at 45, proximate its base. The effect of this contact between walls of gentler gradients is that, instead of prevention of rotation, which occurs with the steeper gradients, the forcing element 50 forces the walls of the resistance recess and the depending cylindrical snap-on pipe 30 upwardly.

The smaller, gentler gradient at 45 (FIG. 7) of the resistance recess wall 44 is similar or identical to the gradient of side wall 54 of the forcing element of the container, which faces resistance recess wall 44 during unscrewing/opening. The gradient of wall of 44 at section 45 is within the range of between 10 degrees more and 10 degrees less than that of wall 54. Thus, if wall 54 is 45 degrees, wall 44 at section 45 is within the range of from 35 degrees to 55 degrees. Each of wall 44 and 54 is within the range of between 30 and 85 degrees. The gradient of wall 44 at section 45 is measured relative to a horizontal line drawn through rim section 56. The gradient of wall 54 is measured at the point at which it first contacts wall 44 upon rotation and is measured with respect to a horizontal line intersecting the point of contact with wall 44, the line being parallel to, or coincident with, bottom rim section 56.

Further counterclockwise rotation of closure 22 during removal of the closure by the consumer will result in forcing element 50 clearing resistance recess wall 44, and the top 58 of the forcing element contacting section 56 of bottom rim 43 of the cylindrical snap-on pipe. Upon still further unscrewing/opening, counterclockwise, rotation of closure 22, top 58 of forcing element 50 encounters guidance recess 70, seen e.g., in FIG. 7. Guidance recess 70 includes an upwardly extending wall 72 at a gradient within the range of 90 and 135 degrees to a horizontal line drawn through section 56 of the bottom rim and then a downwardly extending 74 at a less severe gradient of within the range of 0 to 10 degrees relative to a horizontal line drawn through the intersection 75 of wall 74 and pipe bottom 43.

The distance between resistance recess 42 and the guidance recess 70 is measured along bottom rim section 56 from the point at which wall 44 merges with snap on pipe bottom end or rim 43 to the point at which guidance recess wall 70 begins to ascend at the beginning of wall 72. The distance between the resistance recess and the guidance recess in the unscrewing/opening direction is preferably at least 3 mm. The distance is typically from 2 mm up to 5 mm, especially from 2 mm to 4 mm.

The presence of the guidance recess in addition to the resistance recess also facilitates rotation of the closure in the opposite, closing, direction, which is generally clockwise. When the closure is rotated in the clockwise, closing direction, at point 75 (FIG. 5), forcing element 50 encounters gradually upwardly sloping wall 74 of guidance recess 70, then the steeper, downward slope of wall 72, then rim 43 at section 56 and finally resistance recess wall 44 and steep wall 46.

In operation, during manufacture of the package, closure 22 is snap fit onto neck 32 (e.g., FIG. 2) of bottle 20 by closure 22 being pressed axially downwardly (or bottle 20 being pressed axially upwardly, or both). Since the bottle body and the closure are made of a flexible material and/or because the presence of one or more recesses in the pipe permits the cylindrical snap-on pipe 30 to expand resiliently radially, the internal thread 34 on the cylindrical snap-on pipe passes over the external thread 60 on the container neck and the closure snaps onto the neck. Thus, the closure is securely attached to the container and a substantial amount of effort would be needed for the consumer or other external force to separate them using a vertical or upward motion. Alternatively, closure 22 may initially be applied onto container 20 by being rotated on, to engage the threads.

In normal use, the product is dispensed with cover 26 removed from opening 36. Cover 26 is then closed so that plug 40 seals the opening when the product is not in use.

When the bottle is substantially empty of the shampoo, body wash, lotion or other product originally contained within, the consumer removes closure 22 from the package to facilitate refilling and reusing it. To remove the closure, the consumer rotates it, typically in the counterclockwise direction, starting from the position shown in FIG. 6. When forcing element 50 forces closure 22 upwardly upon closure rotation as described above, cylindrical snap-on pipe thread 34 is forced past container neck thread 60, Thread 34 is able to pass container neck thread 60 since the cylindrical snap-on pipe is able to expand radially due to the presence of the recesses and/or due to the flexible nature of the material of which the cylindrical snap-on pipe is fabricated.

Forcing dement 50 next encounters section 56 of bottom rim 43 of the cylindrical snap-on pipe and then upwardly extending wall 72 of guidance recess 70. The latter permits the cylindrical snap-on pipe axially to lower itself toward the container neck, which in turn permits cylindrical snap-on pipe thread 34 to lie on thread 60 whereupon the consumer can continue to use a normal rotation to unscrew the closure from the container neck. FIG. 5 shows forcing dement 50 within recess 70. This unscrewing rotation is further facilitated by forcing element top 58 contacting downwardly extending wall 74 of guidance recess 70. Contact by the top 58 with downwardly extending wall 74 raises the closure cylindrical snap-on pipe to support the normal unscrewing action of the closure, whereby the closure is easily removed. The pitch of the threads is similar to the gradient of wall 74.

With the closure removed, the consumer then refills the bottle with the shampoo or other product. She then applies the closure back onto the bottle either by snapping the closure downwardly over the bottle neck in an axial direction similar to that used in manufacture, or she screws the closure back on to the bottle neck. If she chooses the latter, the clockwise-moving rim 43 of pipe 30 contacts top 58 of forcing dement 50. When it reaches point 75 (FIG. 5), it encounters gradually ascending wall 74 which contact results in a lowering of the pipe relative to the bottle neck consistent with the normal screwing downwardly of a closure.

When the forward and/or top wall of the forcing dement encounters wall 72 of guidance recess 70, pipe 30 is raised relative to bottle neck 32 and the top 58 of forcing element 50 contacts section 56 of rim 43. Upon further rotation, forcing element reaches resistance recess wall 44 and pipe 30 moves downwardly as forcing dement 50 is accommodated within recess 42. As the consumer further rotates the closure and the pipe moves downwardly, internal thread 34 of pipe 30 is forced past external thread 60 on bottle neck 32 whereby to snap the closure onto the bottle neck. When forcing element wall 52 encounters steep wall 46 of resistance recess 42 the closure cannot be rotated any further.

The closure can be placed on the container neck securely and economically by vertical/axial placement on the bottle during manufacture, whereas by providing the consumer with the ability readily to rotate the closure for removal and to re-apply it to the bottle, refilling of the container is promoted. Closure 22 may be also be applied onto the container during manufacture by being rotated to engage the threads.

References to upward or downward motion herein assume that container 20 is resting on its base (not shown) at its end opposite the closure.

The closure may be made from polypropylene and the bottle can be molded from high-density polyethylene or polypropylene. The closure is designed to be durable, resisting normal wear and tear by opening and closing the closure and even by dropping.

It should be understood, of course, that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A closure comprising a. an upper wall defining an opening;

b. a cylindrical snap-on pipe depending from the upper wall and extending axially to a bottom end having a rim, c. the cylindrical snap-on pipe including at least one resistance recess at the bottom end thereof;

d. the cylindrical snap-on pipe further including at least one thread on a wall thereof;

e. the cylindrical snap-on pipe defining opposing first and second walls of the resistance recess; and f. the bottom end of the cylindrical snap-on pipe being shaped to include a guidance recess for lowering the cylindrical snap-on pipe thread relative to a container neck, the guidance recess including in the closure opening direction a first wall (a) with an upwardly extending gradient relative to the bottom end and a second wall (b) having a downwardly extending gradient toward the bottom end, the downward gradient of the second wall (b) of the guidance recess, and resultant relative upward motion of the closure consistent with gradients of threads on the container neck and skirt providing guidance and permitting turning of the closure in the unscrewing/opening direction, and in the closure closing direction, starting from an intersection of the second wall (b) with the snap-on pipe bottom, ascending second wall (b) which results in lowering of the snap-on pipe relative to the bottle neck and then the first wall (a) of the guidance recess consistent with the snap-on pipe being raised relative to the bottle neck and upon further rotation the resistance recess is encountered and the snap-on pipe moves downwardly.

2. The closure according to claim 1 wherein the distance between the resistance recess and the guidance recess in the unscrewing direction is at least 2 mm.

3. The closure according to claim 2 wherein the distance between the resistance recess and the guidance recess in the unscrewing direction is from 2 mm up to 5 mm.

4. The closure according to claim 3 wherein the distance between the resistance recess and the guidance recess in the unscrewing direction is from 2 mm up to 4 mm.

5. The closure according to claim 1 wherein the first guidance recess wall has a gradient of from 90 to 135 degrees.

6. The closure according to claim 1 further including a closing cover for closing the upper wall opening, the closing cover being hingedly attached to a closure base of the closure.

7. A container comprising a combined closure and bottle, which includes the closure of claim 1 and a bottle having a bottle neck and at least one forcing element, the bottle neck having threads, the at least one bottle forcing element being adapted to be at least partly received within the resistance recess of the closure cylindrical snap-on pipe when the closure is closed.

8. The container according to claim 7 wherein the forcing element has forward and top walls and the first and second resistance recess walls have gradients wherein the gradient of one of the first and second resistance recess walls is smaller at least at one point than the gradient on the other of the first and second recess sides at a point lying at the same axial height, the resistance recess wall with a higher gradient for contacting the forcing element and resisting turning of the closure in a non-opening/screwing closed/closure-securing direction, and the opposite resistance recess wall having a gentler gradient such that when the closure is turned in the opposite, or opening/unscrewing/closure removal direction, contact between the gentler gradient of the opposite wall of the resistance recess and the forcing element forces the closure axially upwardly relative to the container neck.

9. The container according to claim 7 wherein upon contact of the forcing element with the first guidance recess wall the cylindrical snap-on pipe thread and the container thread engage.

10. The container according to claim 8 wherein the second resistance wall includes the smaller gradient and the smaller gradient of the second resistance recess wall is from 10 degrees less to 10 degrees more than a gradient of a side wall of the forcing element of the container which faces the second resistance recess wall during unscrewing the closure, and the smaller gradient of the second resistance wall and the side wall of the forcing element facing said second resistance wall having gradients of between 30 and 85 degrees.

* * * * *